US012662282B2

(12) United States Patent
Ruthe-Steinsiek et al.

(10) Patent No.: US 12,662,282 B2
(45) Date of Patent: Jun. 23, 2026

(54) CARTRIDGE SYSTEM

(71) Applicant: Henkel AG & Co. KGaA, Duesseldorf (DE)

(72) Inventors: Kai Ruthe-Steinsiek, Duesseldorf (DE); Karsten Wolf, Mettmann (DE); Peter Rushe, Duesseldorf (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 117 days.

(21) Appl. No.: 18/826,331

(22) Filed: Sep. 6, 2024

(65) Prior Publication Data

US 2024/0425226 A1 Dec. 26, 2024

Related U.S. Application Data

(63) Continuation of application No. PCT/EP2023/055689, filed on Mar. 7, 2023.

(51) Int. Cl.

| | |
|---|---|
| ***B65D 3/04*** | (2006.01) |
| ***B65D 35/28*** | (2006.01) |
| ***B65D 35/38*** | (2006.01) |

(52) U.S. Cl.

CPC ..... *B65D 3/04* (2013.01); *B65D 35/28* (2013.01); *B65D 35/38* (2013.01)

(58) Field of Classification Search

None

See application file for complete search history.

(56) References Cited

U.S. PATENT DOCUMENTS

| | | | | |
|---|---|---|---|---|
| 2020/0070189 | A1* | 3/2020 | Pappalardo | B65D 83/7713 |
| 2023/0159260 | A1* | 5/2023 | Lee | A22C 11/0209 222/82 |
| 2023/0256466 | A1* | 8/2023 | Lee | B05C 17/00586 222/1 |
| 2024/0351772 | A1* | 10/2024 | Lee | B05C 17/00583 |

FOREIGN PATENT DOCUMENTS

| | | | |
|---|---|---|---|
| DE | 9206256 | U1 | 10/1992 |
| DE | 10351828 | A1 | 7/2005 |
| DE | 102007060382 | A1 | 6/2009 |
| EP | 1209098 | B1 | 4/2005 |
| EP | 2013109 | B1 | 4/2013 |

OTHER PUBLICATIONS

International Search Report of PCT/EP2023/055689, mailed Jun. 14, 2023, 2 pages.

* cited by examiner

*Primary Examiner* — Jeremy Carroll
(74) *Attorney, Agent, or Firm* — Mary K. Cameron

(57) ABSTRACT

A cartridge system comprising: a tubular bag; a cylindrical sleeve having a wall surrounding the tubular bag, the sleeve having a delivery end and a distal end opposite thereto; a distal end closure element releasably connected to the sleeve; a delivery end shoulder element releasably connected to the sleeve and comprising a central through-flow channel, an outlet opening and a piercing point for the tubular bag, wherein the shoulder element has a compression ring which protrudes concentric to the sleeve wall into an interior of the sleeve, the outer diameter of the compression ring being reduced compared to the sleeve's inner diameter such that an annular gap exists between the sleeve wall and compression ring, and a compression chamber inside the compression ring into which the piercing point protrudes, the compression ring protruding further into the sleeve interior than the piercing point.

12 Claims, 5 Drawing Sheets

CARTRIDGE SYSTEM

For applications in construction, but also for DIY work, viscous materials such as silicone, acrylic and adhesives are provided in cartridges, which are equipped with an outlet nozzle for delivering the material and are inserted into a caulking gun. When the caulking gun is operated, a plunger presses against the movable base of the cartridge and pushes it forward, causing the material stored in the cartridge to be pressed out of the cartridge through the outlet nozzle.

Such cartridges are usually made of thick-walled plastics and are designed for one-time filling only. Because it is unavoidable that residues of the material stored in an empty cartridge will adhere to the inner walls of the cartridge, empty cartridges may not be recycled according to the Packaging Ordinance. This results in a considerable amount of plastics waste that has to be incinerated and is lost from the recycling cycle. In addition, due to the high barrier properties required, recycled plastics material can only be used to a very limited extent for the production of such cartridges.

Against the backdrop of increased environmental and sustainability awareness, alternative solutions have already been developed. Instead of cartridges, thin-walled tubular bags that are closed at both ends are used to store the viscous materials. The tubular bags are made of thin laminate films that have high barrier properties. However, to dispense the material from such tubular bags, special caulking guns, so-called sausage caulking guns, are required, into which the tubular bag is completely inserted and which give the flexible tubular bag the necessary external stability on all sides. The tubular bag must be cut open before use. A disadvantage of such sausage caulking guns is that, due to their more complex design, they are significantly more expensive than conventional caulking guns and are therefore less suitable for DIY applications where the caulking gun is used only rarely or even only once.

In addition, a device for emptying bag packages is known, for example from DE 9 206 256 U1, in which a tubular bag is inserted into a tube which externally resembles a conventional cartridge. This cartridge-like tube can be used in a standard caulking gun. When the caulking gun is operated, the tubular bag is pressed against two piercing points disposed on the delivery side of the tube and is torn open by these, so that the contents of the tubular bag are emptied through a dispensing nozzle. The problem with this device is that the piercing points are not able to tear open the tubular bag in a satisfactory and controlled manner, because the tubular bag, due to its flexibility, initially gives way and deforms when it comes into contact with the piercing points. When piercing the comparatively flexible tubular bag, the piercing points often only create small holes in the bag film, through which a sufficient amount of material cannot exit.

SUMMARY OF THE INVENTION

The present invention therefore has the task of providing a cartridge system that is particularly suitable for DIY applications and can be manufactured in a more resource-efficient manner than systems known from the prior art, is more recyclable, and at the same time is easy and reliable to use even for non-professionals. This object is achieved by a method having the features as described and claimed herein. Dependent claims relate to specific embodiments and developments of the invention.

A cartridge system comprising a tubular bag containing a viscous material, a cylindrical sleeve with a sleeve wall which completely surrounds the tubular bag, the sleeve having a delivery-side end and a distal end opposite the delivery-side end, a closure element which is disposed at the distal end of the sleeve and is releasably connected to the sleeve, and a shoulder element which is disposed at the delivery-side end of the sleeve and is releasably connected to the sleeve, the shoulder element comprising a central through-flow channel and an outlet opening for delivering the viscous material out of the cartridge system and having at least one piercing point for piercing the tubular bag. The invention is characterized in that the shoulder element has a compression ring which protrudes concentric to the sleeve wall into an interior of the sleeve delimited by the sleeve wall and the outer diameter of which compression ring is reduced compared to the inner diameter of the sleeve such that an annular gap is formed between the sleeve wall and the compression ring, a compression chamber being formed inside the compression ring, into which compression chamber the at least one piercing point protrudes.

In other words, the cartridge system according to the invention is a system consisting of a plurality of releasably connected individual components which can be separated from one another and disposed of individually after the tubular bag has been emptied. In particular, the shoulder element, the closure element and the sleeve can be separated from one another, and the closure element and the sleeve can be fed into the appropriate recycling cycle depending on the materials used. The emptied tubular bag and the shoulder element must still be disposed of as residual waste due to adhering product residues, but the plastics content is significantly lower than in the case of a conventional cartridge.

The cartridge system according to the invention is designed in its dimensions and functionality to be operated with a conventional caulking gun. Despite the use of a tubular bag, a special sausage caulking gun is not necessary.

The tubular bag of the cartridge system according to the invention may be made from a film tube. For example, after the filling process, the ends of the film tube are closed like sausage ends. Clamps, clips or adhesive or welded seams may be used for this purpose. However, instead of using a film tube to produce the tubular bag, other manufacturing processes are also conceivable. For example, the tubular bag body may be bias-molded, preferably using a thermoplastic material.

The cartridge system according to the invention is further characterized in that the shoulder element has at least one piercing point for piercing the tubular bag and a compression ring which protrudes concentric to the sleeve wall into an interior of the sleeve delimited by the sleeve wall. The outer diameter of the compression ring is smaller than the inner diameter of the sleeve, so that an annular gap is formed between the sleeve wall and the compression ring. A compression chamber is formed inside the compression ring, into which compression chamber at least one piercing point protrudes. According to the invention, the compression ring protrudes further into the interior of the sleeve than the at least one piercing point. Particularly preferably, the compression ring protrudes at least 0.5 to 10.0 mm further into the interior of the sleeve than the at least one piercing point. Such a design can reduce the risk of the tubular bag being accidentally punctured by a piercing point, for example during storage, transport or if the cartridge system falls from a certain height. The diameter of the tubular bag filled with viscous material is slightly smaller than the inner diameter of the sleeve, but larger than the outer diameter of the compression ring.

The function of the compression ring in interaction with the at least one piercing point will be explained in the following. To dispense the viscous material, the cartridge system is inserted into a standard caulking gun. In contrast to a sausage caulking gun, a standard caulking gun is a caulking gun that has an at least partially open receiving body for a cartridge, for example a half-shell. Some of these caulking guns are also designed as skeleton guns, where the receiving body is formed by a thin frame made of plastics or metal. By operating the caulking gun, pressure is exerted on the tubular bag inside the sleeve in the direction of the delivery-side end of the sleeve. As a result, the tubular bag is moved toward the delivery-side end of the sleeve and its delivery-side end initially comes into contact with the compression ring, which protrudes into the interior of the sleeve. Continued pressure on the tubular bag then causes part of its delivery-side end to be pressed into the interior of the compression ring, known as the compression chamber. The reduced diameter of the compression ring compared to the diameter of the sleeve means that a higher internal pressure builds up more quickly at the delivery-side end of the tubular bag than would be the case without the compression ring. The part of the tubular bag pressed into the compression chamber is therefore particularly firm and taut. This means that as soon as the tubular bag is pressed by continued pressure onto the at least one piercing point protruding into the compression chamber, it is not only punctured at specific points but actually bursts open. The stored and pressurized material exits from the resulting, comparatively large opening in the tubular bag and is conveyed out of the cartridge system through the through-flow channel and the outlet opening. The cartridge system according to the invention thus enables automatic and reliable opening of the tubular bag, which makes it a very user-friendly system. In particular, this eliminates the need for an additional tool, such as a knife, to open the tubular bag.

It may be provided that the shoulder element has a plurality of, for example two or three, piercing points, whereby the tubular bag can be torn open even better and more reliably.

The outer diameter of the compression ring is smaller than the inner diameter of the sleeve. This creates an annular gap between the sleeve wall and the compression ring. During the emptying process of the tubular bag, parts of the tubular bag film are forced into this annular gap by the pressure acting on the tubular bag. At the same time, this seals the opened tubular bag against the interior of the sleeve, so that, if the outlet opening is additionally sealed, the viscous material from a tubular bag once it has been opened does not dry out and can be reused at a later time.

According to one embodiment of the invention, the cylindrical sleeve is made of a plant-fiber-based material. For example, the sleeve can be made of cardboard. After the shoulder element, closure element and tubular bag have been separated, the tube can be added to the waste paper and thus returned to the recycling cycle. The sleeve can already be made from recycled paper material, making the cartridge system an even more sustainable product. The sleeve, which is made from a plant-fiber-based material, may in principle be printed, but according to one embodiment it does not contain any further coating made from another material, such as plastics or aluminum, in order to enable efficient recycling. According to an alternative embodiment, the sleeve made of a plant-fiber-based material may have a moisture-repellent coating for protection against moisture.

The shoulder element and the closure element may be manufactured from a thermoplastic material, for example by injection molding. Suitable materials include polyethylene or polypropylene. Because the closure element is usually completely free of contamination by product residues, it can be recycled for plastics after the cartridge system has been emptied and separated from the sleeve.

Overall, such a cartridge system according to the invention comprises up to about 65% less plastics than a conventional cartridge.

One embodiment of the invention provides that the shoulder element comprises a press ring which is formed concentric to the compression ring and is pressed into the sleeve at the delivery-side end of the sleeve and rests against the sleeve wall from the inside, wherein the inner diameter of the press ring is larger than the outer diameter of the compression ring, so that the annular gap is formed between the press ring and the compression ring. As already described above, parts of the tubular bag film are forced into this gap during the emptying process of the tubular bag by the pressure acting on the tubular bag. According to one embodiment of the invention, the press ring protrudes less far into the interior of the sleeve than the compression ring, starting from the delivery-side end of the sleeve, so that the tubular bag pushed forward within the sleeve first contacts the compression ring and is braced by it in the manner described above. The press ring may have a texture on its outer circumference, for example a rib texture or a knob texture. The outer diameter of the press ring is matched to the inner diameter of the sleeve in such a way that the press ring can be pressed under pressure into the delivery-side end of the sleeve during the manufacture of the cartridge system. Alternatively, the press ring may have a kind of self-cutting thread on the outer circumference, which additionally cuts into the sleeve material. In this way, the shoulder element is firmly but releasably connected to the sleeve. Once the cartridge system has been emptied, the shoulder element can be separated from the sleeve by a user and the two components can be disposed of separately.

As an alternative to a press ring pressed into the sleeve and resting against the sleeve wall from the inside, the shoulder element may comprise a locking ring which is formed concentric to the compression ring and rests against the sleeve wall from the outside. In this case, the shoulder element and sleeve are connected via the locking ring which is pressed onto the sleeve from the outside and rests against the outer sleeve wall and which may have a texture, for example a rib texture or a knob texture, on its circumferential surface facing the sleeve wall. The inner diameter of the locking ring is matched to the outer diameter of the sleeve in such a way that the shoulder element can be pressed under pressure onto the delivery-side end of the sleeve by means of the locking ring during the manufacture of the cartridge system. In this way, the shoulder element is firmly but releasably connected to the sleeve.

According to one embodiment of the invention, a circumferential shoulder edge is formed on the shoulder element, which shoulder edge rests on the end-face edge of the sleeve wall at the delivery-side end of the sleeve. This prevents the shoulder element from accidentally entering too far into the sleeve.

In one embodiment of the invention, it may be provided that an undercut is formed on the shoulder element on the inside adjacent to the circumferential shoulder edge. The displaceable plunger described below can engage or snap into the recess formed by such an undercut when approaching the delivery-side end of the cartridge system together with the emptied tubular bag, so that a user can remove the shoulder element together with the emptied tubular bag and the plunger as a unit from the sleeve and dispose of it separately from the sleeve. The plunger can be snapped into place, for example by virtue of sealing lips, which are formed on the plunger and described in more detail below, snapping into the recess in the shoulder element formed by the undercut. Such a design with an undercut is possible both for the design of the shoulder element with a press ring and for the design with a locking ring.

The shoulder member may comprise a dispensing nozzle integrally formed with the shoulder member adjacent to the outlet opening. It may also be provided that the shoulder element has an external thread in the region of the outlet opening, via which thread the shoulder element can be connected to a separate dispensing nozzle. Preferably, a delivery nozzle is used which has a dispensing opening for applying the viscous material, which opening has a diameter of at least 3 mm, particularly preferably at least 4 mm.

One embodiment of the invention provides that the outlet opening is closed by a breakaway reclosure part. In other words, a reclosure part may be provided which is initially firmly connected to the shoulder element and closes the outlet opening so that it is protected against the ingress of dust and other contamination. The connection between the reclosure part and the shoulder element may include predetermined breaking points which can be broken open by a user before the cartridge system is put into operation in order to separate the reclosure part from the shoulder element. The reclosure part may be conical so that after separation from the shoulder element it can serve either as a closure for the dispensing opening of a delivery nozzle or as a closure for the outlet opening of the shoulder element by being sealingly inserted therein. The conicity of the reclosure part enables the sealing of outlet openings or dispensing openings of different diameters.

According to one aspect of the invention, the closure element disposed at the distal end of the sleeve may comprise a plunger displaceable in the sleeve and a closure ring pressed into the sleeve. The closure ring is disposed directly at the distal end of the sleeve, while the plunger is disposed between the closure ring and the tubular bag. In principle, the plunger and the closure ring may be designed as two separate parts. However, according to one embodiment of the invention, it may also be provided that the plunger and the closure ring are formed as one piece and are connected to one another via at least one connecting web designed as a predetermined breaking point. In this case, the closure element may therefore comprise two components which are initially connected to one another.

The functionality of the two components will be explained in more detail in the following. To dispense the material stored in the tubular bag, the cartridge system is inserted into a standard caulking gun. When the caulking gun is operated, a rod disposed on the caulking gun is pressed against the closure element. The rod passes through the closure ring and comes into contact with the plunger. In the case of a one-piece closure element, the pressure exerted by the rod on the plunger initially leads to a breaking of at least one connecting web between the closure ring and the plunger and, as a result, to a movement of the plunger toward the delivery-side end of the sleeve. The plunger exerts pressure on the tubular bag, which is thus moved toward the delivery-side end of the sleeve in the manner described above. The closure ring pressed into the sleeve remains unchanged in its position at the distal end of the sleeve.

The closure ring may have a texture on its outer circumference, for example a rib texture or a knob texture. The outer diameter of the closure ring is matched to the inner diameter of the sleeve so that the closure ring can be pressed under pressure into the distal end of the sleeve during the manufacture of the cartridge system. In this way, the closure element comprising the closure ring and the plunger is firmly but releasably connected to the sleeve. The pressed-in closure ring at the distal end of the sleeve and the pressed-in shoulder element at the delivery-side end of the sleeve ensure that the tubular bag is safely prevented from slipping out of the sleeve before and while the cartridge system is put into operation. After the cartridge system has been emptied, the closure ring and the plunger as well as the shoulder element can be separated from the sleeve by a user, and all components can be disposed of separately.

According to one embodiment of the invention, at least one sealing lip can be formed on the circumference of the plunger. The sealing lip rests directly against the inside of the sleeve wall and prevents tubular bag film from penetrating the region between the sealing lip and the distal end of the sleeve. It can be provided that two or more sealing lips distributed over the height of the plunger are provided on the plunger, whereby sealing is provided to an even better extent. In this way, it can be reliably prevented that parts of the emptied tubular bag film enter the region between the plunger and the closure ring and cause components of the caulking gun to jam. At the same time, the formation of sealing lips on the circumference of the plunger has the advantage that the plunger does not rest against the inner wall of the sleeve over its entire height, which means that there is less friction between the plunger and the inner wall of the sleeve and the plunger is more easily displaceable within the sleeve. Finally, the slightly flexible sealing lips can compensate for internal dimensional tolerances of the sleeve to a certain extent. The sealing lips can be molded directly onto the plunger and, like the plunger, can be made of a thermoplastic material, for example polyethylene or polypropylene.

It can be provided that a circumferential shoulder edge is formed on the closure ring, which edge rests on the end-face edge of the sleeve wall at the distal end of the sleeve. This prevents the closure ring from accidentally entering too far into the sleeve in the same way as described above for the shoulder element.

According to one embodiment of the invention, a weakened region can be provided in the sleeve wall in a region adjacent to the delivery-side end of the sleeve. The weakened region can, for example, comprise a weakened line in the form of a perforation, an incision or a notch in the sleeve wall. Such a weakened line may extend over a length of about 8 to 25 mm, the distance between the weakened line and the delivery-side end of the sleeve being about 5 to 15 mm. The weakened line preferably extends substantially in the axial direction in the sleeve wall. It can also run in an oblique direction that has directional components in both the axial direction and circumferential direction. The weakened region may comprise a single weakened line or a plurality of weakened lines. For example, the weakened region may comprise two crossed weakened lines, each of which runs obliquely within the sleeve wall with respect to an axial direction. The formation of such a weakened region serves to facilitate the tearing open of the sleeve wall during the emptying of the tubular bag with the aim of being able to better separate the individual components from one another and dispose of them individually. During its advancing movement, the plunger compresses the tubular film material in the region of the delivery-side end in such a way that the pressure on the sleeve wall increases there. If a pressure threshold value that can be set by the specific design of the weakened region is exceeded, the sleeve eventually tears or bursts, so that a user can then simply separate the sleeve from the other components and dispose of it accordingly.

BRIEF DESCRIPTION OF THE DRAWINGS

In the following, the invention is explained in more detail by means of an exemplary embodiment and with reference to the attached figures. In the figures.

DETAILED DESCRIPTION OF EMBODIMENTS

Figure 1:
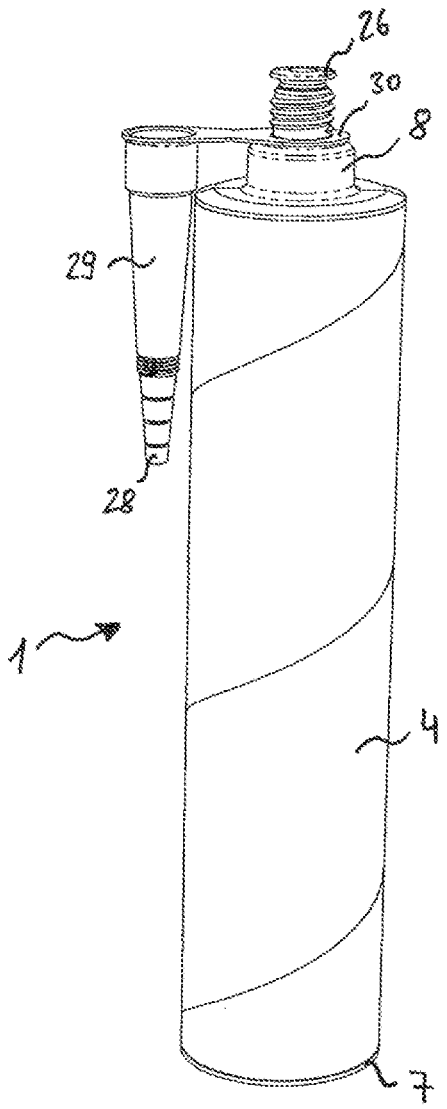
FIG. 1: shows a cartridge system according to the invention in a perspective view.

FIG. 1 shows a cartridge system according to the invention, designated as a whole by 1, in a perspective view. The cartridge system looks similar to a conventional cartridge and can be inserted into a standard caulking gun.

Figure 2:
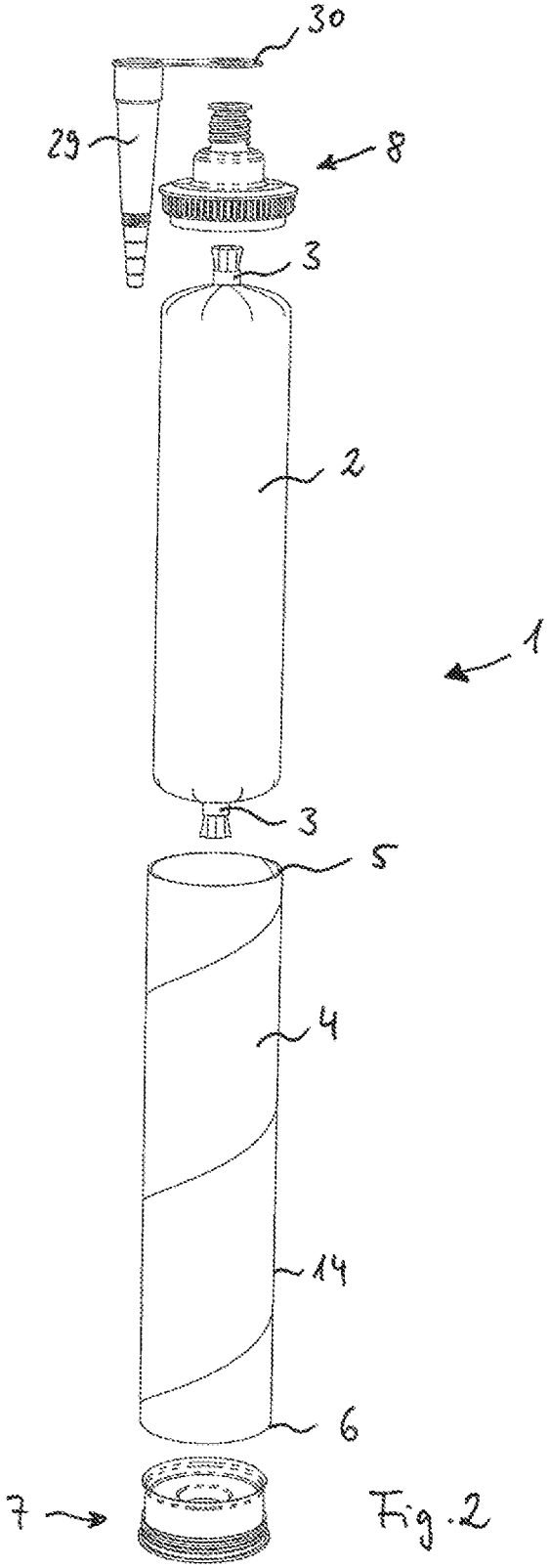
FIG. 2: shows the cartridge system from FIG. 1 in an exploded view.
Figure 3:
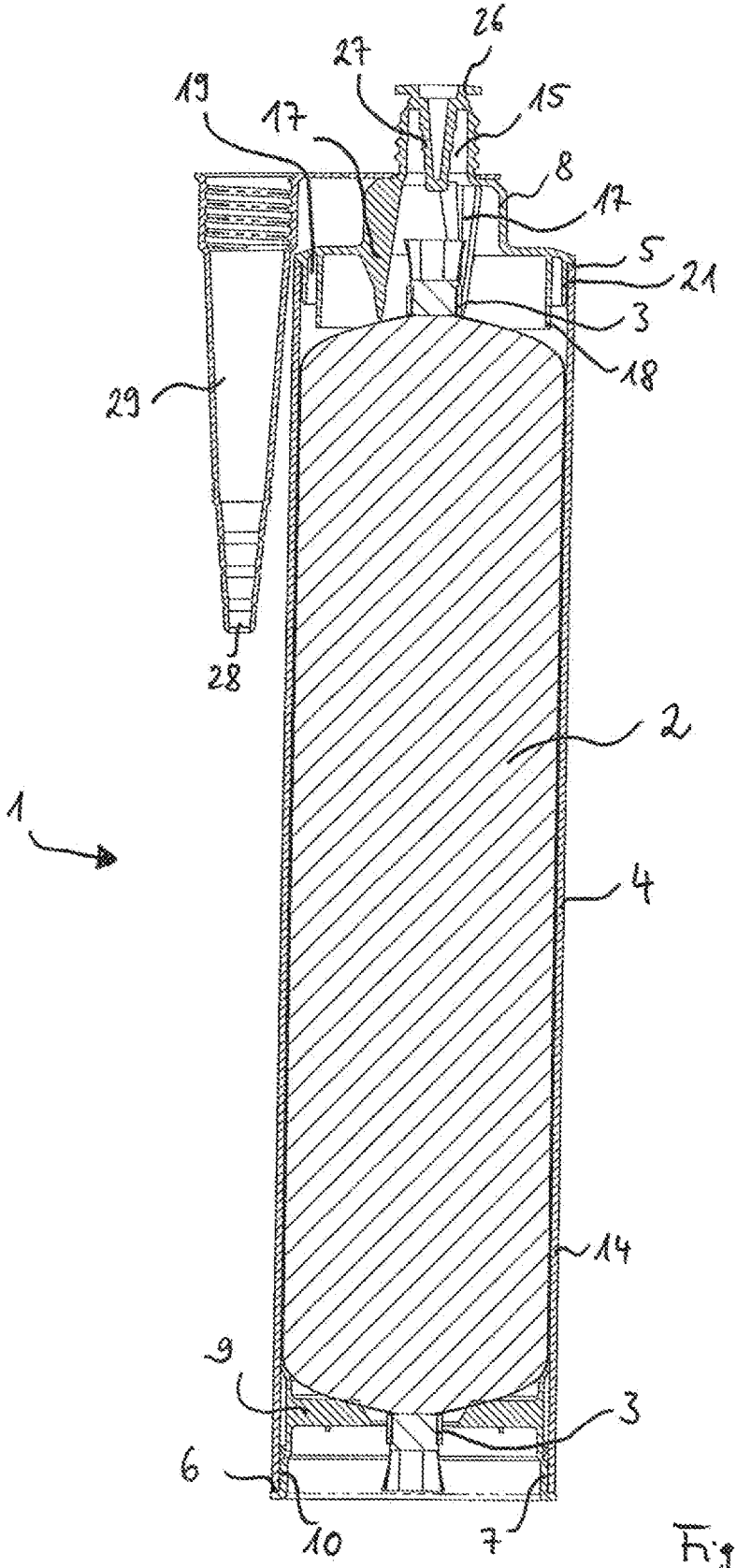
FIG. 3: shows the cartridge system from FIG. 1 in a sectional view.
Figure 4:
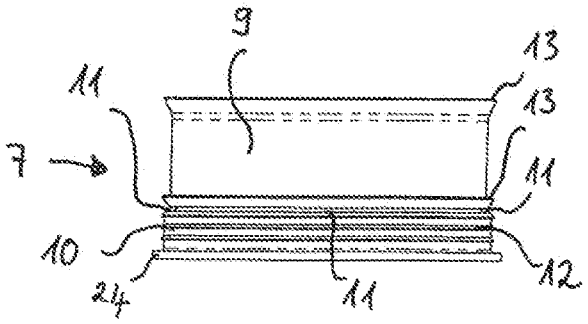
FIG. 4: shows a closure element in a side view.
Figure 5:
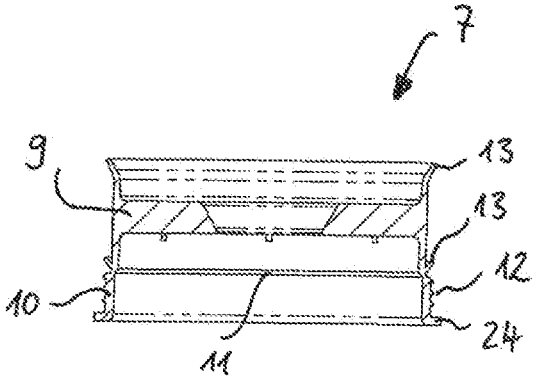
FIG. 5: shows the closure element from FIG. 4 in a sectional view.
Figure 6:
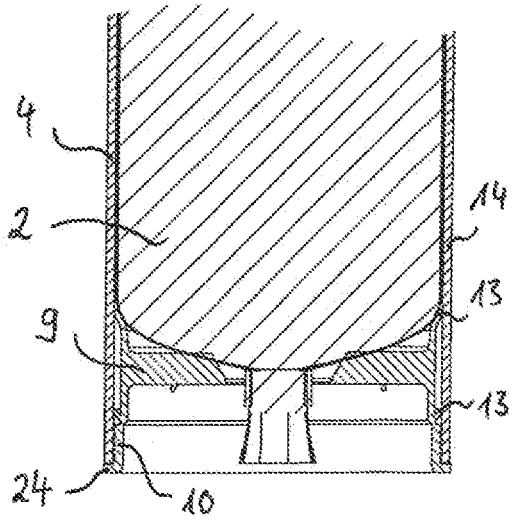
FIG. 6: shows the distal end of the cartridge system from FIG. 1 before the cartridge system is put into operation in a sectional view.
Figure 7:
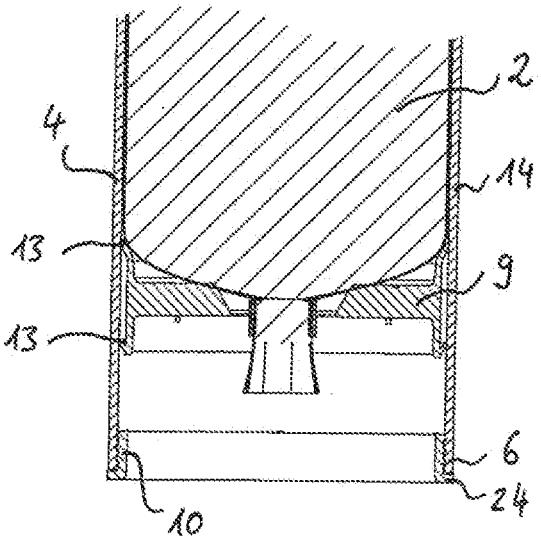
FIG. 7: shows the distal end of the cartridge system from FIG. 1 after the cartridge system is put into operation in a sectional view.

The structure of the cartridge system 1 is evident from the exploded view in FIG. 2 and the sectional view in FIG. 3. It comprises a tubular bag 2 containing a viscous material, in this case silicone. The tubular bag 2 is made of a laminate film, also referred to below as tubular bag film, and is closed at both ends by clips 3. Perpendicular to its longitudinal extension, the tubular bag 2 has a substantially circular cross-section, so that the filled tubular bag 2 has a sausage-shaped configuration. The tubular bag 2 is disposed completely within a cylindrical sleeve 4 made of cardboard, which comprises recycled paper material. The sleeve 4 has a delivery-side end 5 and a distal end 6 opposite the delivery-side end 5, and comprises a sleeve wall 14.

The cartridge system 1 further comprises a closure element 7, which is disposed at the distal end 6 of the sleeve 4 and is releasably connected to the sleeve 4, and a shoulder element 8, which is disposed at the delivery-side end 5 of the sleeve 4 and is releasably connected to the sleeve 4. Both the closure element 7 and the shoulder element 8 are made of polypropylene using an injection molding process.

The structure of the closure element 7 is shown in more detail in FIGS. 4 to 7. It comprises a plunger 9 which is displaceable within the sleeve 4 and a closure ring 10 which is pressed into the sleeve 4. The plunger 9 and the closure ring 10 are initially connected to one another via narrow connecting webs 11 designed as predetermined breaking points. The described exemplary embodiment comprises four such connecting webs 11, which are evenly distributed over the circumference of the closure ring 10, and of which only three connecting webs 11 can be seen in FIG. 4. When the cartridge system 1 is put into operation by a user using a caulking gun, the connecting webs 11 are broken open and the plunger 9 is then displaceable within the sleeve 4 independently of the closure ring 10. As can be seen from FIGS. 3, 6 and 7, the plunger 9 rests directly against the distal end of the tubular bag 2, so that the tubular bag 2 is also moved in the direction of the delivery-side end 5 of the sleeve 4 by a movement of the plunger 9 in the direction of the delivery-side end 5 of the sleeve 4; see FIG. 7. The closure ring 10 remains in its position at the distal end 6 of the sleeve 4.

The outer diameter of the closure ring 10 is matched to the inner diameter of the sleeve 4 in such a way that the closure ring 10 can be pressed under pressure into the distal end 6 of the sleeve 4 during the manufacture of the cartridge system 1. For this purpose, the closure ring 10 has a texture of horizontally disposed ribs 12 on its outer circumference. The pressed-in closure element 7 at the distal end 6 of the sleeve 4 safely prevents the tubular bag 2 from slipping out of the sleeve 4 before and while the cartridge system 1 is put into operation. After the cartridge system 1 has been emptied, the closure ring 10 and the plunger 9 can be separated from the sleeve 4, and all components can be disposed of separately.

Two sealing lips 13 are formed on the circumference of the plunger 9 and are made of the same material as the plunger 9 itself, in this case polypropylene. As can be seen from FIGS. 6 and 7, the sealing lips 13 rest directly against the inside of the sleeve wall 14. In this way, it is possible to reliably prevent parts of the emptied tubular bag film from entering the region between the plunger 9 and the closure ring 10 during the emptying process of the cartridge system 1 and leading in such a case to a jamming of components of the caulking gun. At the same time, the formation of sealing lips 13 on the circumference of the plunger 9 has the advantage that the plunger 9 does not rest against the inner wall of the sleeve 4 over its entire height, whereby there is less friction between the plunger 9 and the inner wall of the sleeve 4 and the plunger 9 is more easily displaceable within the sleeve 4.

The structure of the shoulder element 8 is shown in more detail in FIGS. 8 to 11. The shoulder element 8 comprises a central through-flow channel 15 and an outlet opening 16 for delivering the viscous material out of the cartridge system 1. In the region of the outlet opening 16, the shoulder element 8 has an external thread 30, via which the shoulder element 8 can be connected to a separate dispensing nozzle 29.

The shoulder element 8 also has three piercing points 17, of which only two piercing points 17 can be seen in the figures. At its end facing the sleeve 4, the shoulder element 8 has a compression ring 18 which protrudes concentric to the sleeve wall 14 into the interior of the sleeve 4 delimited by the sleeve wall 14; see FIG. 10. The outer diameter of the compression ring 18 is reduced compared to the inner diameter of the sleeve 4 in such a way that an annular gap 19 is formed between the sleeve wall 14 and the compression ring 18. Within the compression ring 18, a compression chamber 20 is formed into which the piercing points 17 protrude. Before the cartridge system 1 is put into operation—this situation is shown in FIGS. 3 and 10—the piercing points 17 may touch the tubular bag 2, but they do not yet pierce the tubular bag film due to a lack of pressure on the tubular bag 2.

In addition to the compression ring 18, the shoulder element 8 also comprises a press ring 21, which is formed concentric to the compression ring 18 and is pressed into the sleeve 4 and rests against the sleeve wall 14 from the inside. The inner diameter of the press ring 21 is larger than the outer diameter of the compression ring 18, so that the annular gap 19 is formed between the press ring 21 and the compression ring 18. During the emptying process of the tubular bag 2, parts of the tubular bag film are forced into this annular gap 19 by the pressure acting on the tubular bag 2, which can be seen in part from FIG. 11. At the same time, this provides a seal between the opened tubular bag 2 and the interior of the sleeve 4, so that when the outlet opening 16 is additionally sealed, the viscous material from the tubular bag 2, once opened, does not dry out and can be reused at a later time.

Figure 10:
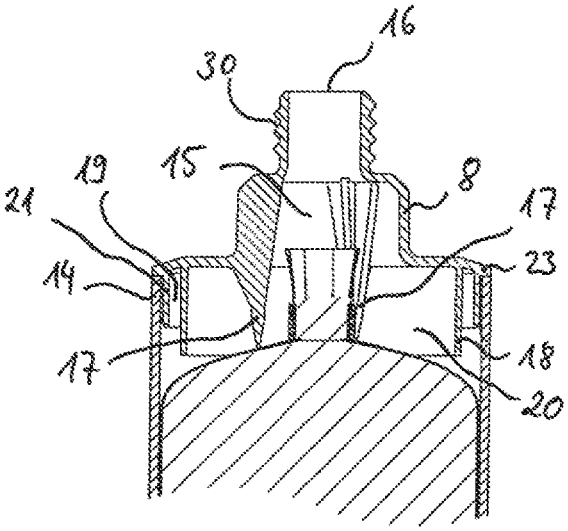
FIG. 10: shows the delivery-side end of the cartridge system from FIG. 1 before the cartridge system is put into operation in a sectional view.
Figure 11:
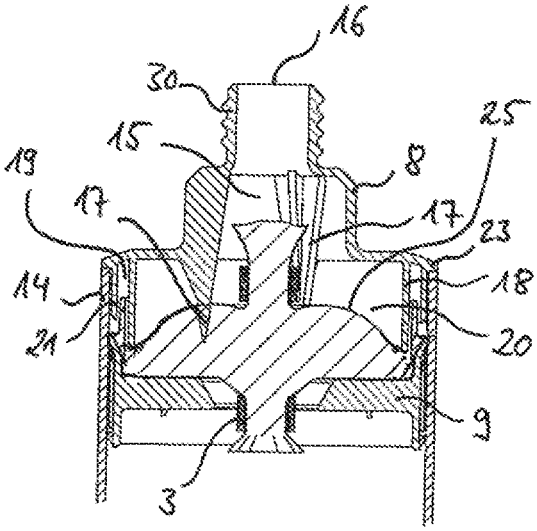
FIG. 11: shows the delivery-side end of the cartridge system from FIG. 1 after the cartridge system is put into operation in a sectional view.

Starting from the delivery-side end 5 of the sleeve 4, the press ring 21 protrudes less far into the interior of the sleeve 4 than the compression ring 18, so that the tubular bag 2 pushed forward within the sleeve 4 first contacts the compression ring 18 during an emptying process of the cartridge system 1; see FIGS. 10 and 11. The outer diameter of the press ring 21 is matched to the inner diameter of the sleeve 4 in such a way that the press ring 21 can be pressed under pressure into the delivery-side end 5 of the sleeve 4 during the manufacture of the cartridge system 1. For this purpose, the press ring 21 has a texture of vertically disposed ribs 22 on its outer circumference. After the cartridge system 1 has been emptied, the shoulder element 8 can be separated from the sleeve 4 by a user, and both components can be disposed of separately.

The shoulder element 8 has a circumferential shoulder edge 23 which, in the inserted position, rests on the end-face edge of the sleeve wall 14 at the delivery-side end 5 of the sleeve 4; see FIGS. 10 and 11. In the same way, a circumferential shoulder edge 24 is formed on the closure ring 10 and rests on the end-face edge of the sleeve wall 14 at the distal end 6 of the sleeve 4; see FIGS. 6 and 7.

The functionality of the cartridge system 1 is described in the following.

In order to dispense the silicone material stored in the tubular bag 2, the cartridge system 1 is inserted into a standard caulking gun (not shown in the figures). When the caulking gun is operated, a rod disposed on the caulking gun is pressed against the closure element 7. The rod passes through the closure ring 10 and comes into contact with the plunger 9. The pressure exerted by the rod on the plunger 9 initially leads to a breaking of the four connecting webs 11 between the closure ring 10 and the plunger 9 and subsequently to a movement of the plunger 9 toward the delivery-side end 5 of the sleeve 4. The plunger 9 exerts pressure on the tubular bag 2, which is thereby moved in the direction of the delivery-side end 5 of the sleeve 4. The closure ring 10 pressed into the sleeve 4 remains unchanged in its position at the distal end 6 of the sleeve 4; see FIG. 7.

The advanced tubular bag 2 finally comes to rest with its delivery-side end against the compression ring 18 protruding into the interior of the sleeve 4; see FIG. 11. Continued pressure on the tubular bag 2 then leads to said bag being pressed with part of its delivery-side end into the interior of the compression ring 18, referred to as the compression chamber 20. The reduced diameter of the compression ring 18 compared to the diameter of the sleeve 4 causes a higher internal pressure to build up more quickly at the delivery-side end of the tubular bag 2 than would be the case without the compression ring 18. The part of the tubular bag 2 pressed into the compression chamber 20 is therefore particularly firm and taut; see the tubular bag film portion 25 in FIG. 11. This has the consequence that the tubular bag 2, as soon as it is pressed by continued pressure onto the piercing points 17 protruding into the compression chamber 20, is not only pierced at specific points by these, but actually bursts open. The stored and pressurized silicone material exits from the resulting, comparatively large opening in the tubular bag 2 and is conveyed out of the cartridge system 1 through the through-flow channel 15 and the outlet opening 16. The cartridge system 1 according to the invention thus enables automatic and reliable opening of the tubular bag 2, which makes it a very user-friendly system.

Figure 8:
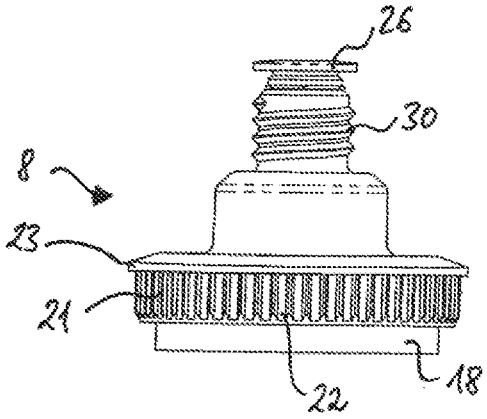
FIG. 8: shows a shoulder element in a side view.
Figure 9:
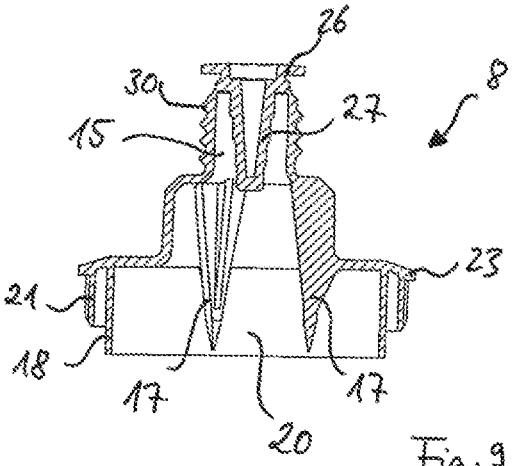
FIG. 9: shows the shoulder element from FIG. 8 in a sectional view.

From FIGS. 3, 8 and 9 it can be seen that the outlet opening 16 is closed by a breakaway reclosure part 26. The reclosure part 26 is initially firmly connected to the shoulder element 8 and closes the outlet opening so that it is protected against the ingress of dust and other contamination before the cartridge system 1 is put into operation. The connection between the reclosure part 26 and the shoulder element 8 comprises four predetermined breaking points, which cannot be seen in the figures and which can be broken open by a user to separate the reclosure part 26 from the shoulder element 8. The reclosure part 26 is conical and protrudes with its conical point 27 into the outlet opening 16. After separation from the shoulder element 8, the reclosure part 26 may serve as a closure for the dispensing opening 28 of a delivery nozzle 29 by being sealingly inserted therein. The conicity of the reclosure part 26 enables the dispensing opening 28 to be sealed even if its diameter is increased, for example by cutting off the front region of the delivery nozzle 29.

Although the dispensing nozzle 29 is designed separately in the described exemplary embodiment, it is connected to the shoulder element 8 in a captive manner via a ring 30. Because the external thread 30 is a standard thread, any other standard dispensing nozzle may also be connected to the shoulder element 8.

The external dimensions of the cartridge system 1 correspond to those of a standard cartridge, which makes it possible to operate the cartridge system 1 with a standard caulking gun. In the described exemplary embodiment, the filled tubular bag 2 has a diameter in the range of approximately 44.0 to 46.5 mm and a capacity of approximately 300 ml. The sleeve wall 14 has a thickness of approximately 1.0 to 1.5 mm, and the inner diameter of the sleeve 4 is approximately 46.3-46.7 mm. The compression ring 18 has an inner diameter of approximately 38.0 to 41.0 mm and, starting from the end-face edge of the sleeve wall 14, it protrudes approximately 11.0 to 13.0 mm into the interior of the sleeve 4. The sealing lips 13 have a thickness of approximately 0.4 mm. In the region of the sealing lips, the plunger 9 has a diameter of approximately 46.4-46.9 mm, so that it rests with the sealing lips 13 against the inner wall of the sleeve 4. Between the sealing lips 13 there is a gap approximately 1.0 to 1.5 mm wide between the plunger 9 and the sleeve wall 14.

Figure 12:
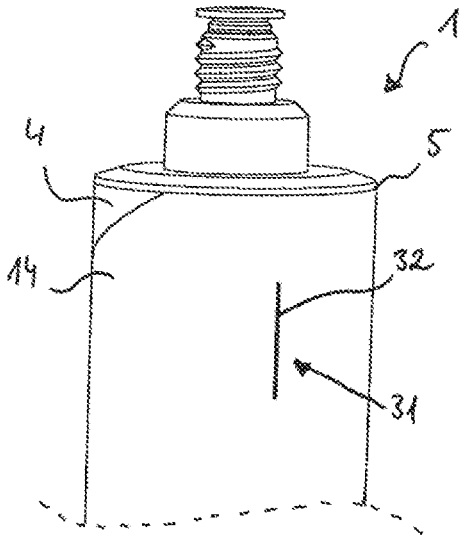
FIG. 12: shows an exemplary embodiment of a cartridge system having a weakened region formed in the sleeve wall.
Figure 13:
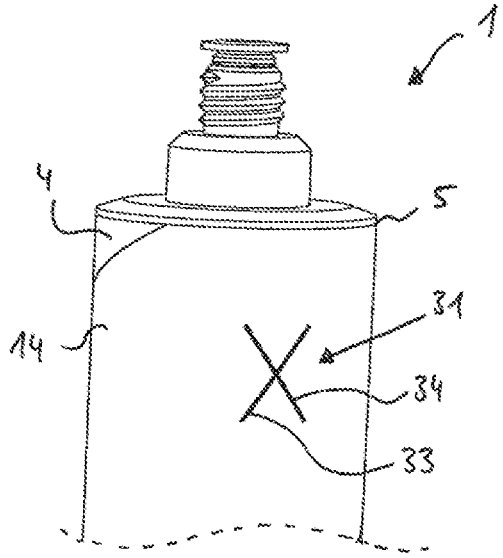
FIG. 13: shows a further exemplary embodiment of a cartridge system having a weakened region formed in the sleeve wall.

FIGS. 12 and 13 each show a detail of a cartridge system 1 with a weakened region 31 formed in the sleeve wall 14 in the region of the delivery-side end 5. In the exemplary embodiment shown in FIG. 12, the weakened region 31 comprises a weakened line 32 formed as an incision in the sleeve wall 14, which line has a length of approximately 12 mm and a distance of approximately 8 mm from the delivery-side end 5 of the sleeve 4. The weakened line 32 runs in the axial direction, i.e., in a direction parallel to the longitudinal axis of the cartridge system 1. FIG. 13 shows a further exemplary embodiment in which the weakened region 31 comprises two obliquely running, crossed weakened lines 33 and 34. The weakened lines are formed as incisions in the sleeve wall 14 and also in this case each have a length of approximately 12 mm and a distance of approximately 8 mm from the delivery-side end 5 of the sleeve 4. Alternatively, it is also conceivable that the weakened region 31 comprises only one of the two obliquely running weakened lines 33, 34.

The formation of such weakened regions 31 serves to facilitate the tearing open of the sleeve wall 14 with the aim of being able to better separate the individual components from one another and dispose of them individually. Due to the pressure that builds up in the region of the sleeve wall 14 during the emptying of the tubular bag 2, the sleeve 4 tears or bursts in the weakened region 31, so that a user can then simply separate the sleeve 4 from the other components and dispose of both accordingly.

Figure 14:
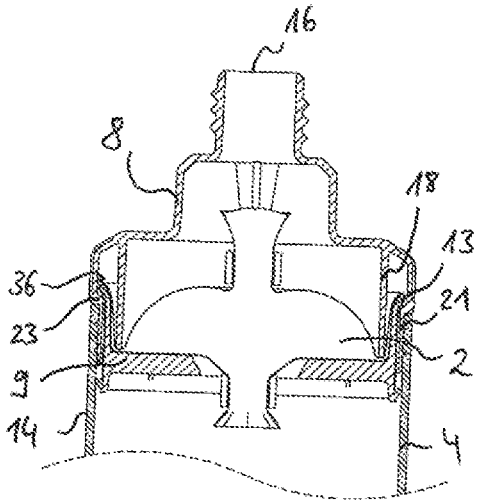
FIG. 14: shows an exemplary embodiment of the shoulder element with an undercut.
Figure 15:
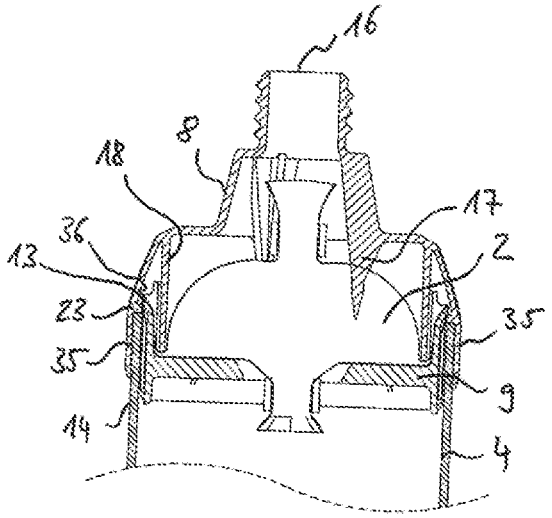
FIG. 15: shows a further exemplary embodiment of the shoulder element with an undercut.

FIGS. 14 and 15 show embodiments of the shoulder element 8 according to the invention in which an undercut 36 is formed on the shoulder element 8 on the inside adjacent to the circumferential shoulder edge 23. When approaching the delivery-side end of the cartridge system 1, the displaceable plunger 9 can engage or snap into the recess formed by the undercut 36, together with the emptied tubular bag 2, so that a user can remove the shoulder element 8 together with the emptied tubular bag 2 and the plunger 9 as a unit from the sleeve 4 and dispose of it separately from the sleeve 4. The plunger 8 snaps into place here by the sealing lip 13 formed on the plunger 8 snapping into the recess formed by the undercut 36 in the shoulder element 8.

In the embodiment according to FIG. 14, the shoulder element 8 comprises a press ring 21 which is pressed into the sleeve 4 and rests against the sleeve wall 14 from the inside. In contrast, in the embodiment according to FIG. 15, the shoulder element 8 comprises a locking ring 35 which rests against the sleeve wall 14 from the outside.

The invention claimed is:

1. A cartridge system, comprising a tubular bag containing a viscous material, a cylindrical sleeve with a sleeve wall which completely surrounds the tubular bag, the sleeve having a delivery-side end and a distal end opposite the delivery-side end, a closure element which is disposed at the distal end of the sleeve and is releasably connected to the sleeve, and a shoulder element which is disposed at the delivery-side end of the sleeve and is releasably connected to the sleeve, the shoulder element comprising a central through-flow channel and an outlet opening for delivering the viscous material out of the cartridge system and having at least one piercing point for piercing the tubular bag, wherein the shoulder element has a compression ring which protrudes concentric to the sleeve wall into an interior of the sleeve delimited by the sleeve wall and the outer diameter of which compression ring is reduced compared to the inner diameter of the sleeve such that an annular gap is formed between the sleeve wall and the compression ring, a compression chamber being formed inside the compression ring, into which compression chamber the at least one piercing point protrudes, with the compression ring protruding further into the interior of the sleeve than the at least one piercing point.

2. The cartridge system according to claim 1, wherein the cylindrical sleeve is made of a plant-fiber-based material.

3. The cartridge system according to claim 1, wherein the shoulder element comprises a press ring which is formed concentric to the compression ring and is pressed into the sleeve and rests against the sleeve wall from the inside, the inner diameter of the press ring being larger than the outer diameter of the compression ring, so that the annular gap is formed between the press ring and the compression ring.

4. The cartridge system according to claim 1, wherein the shoulder element comprises a locking ring which is formed concentric to the compression ring and rests against the sleeve wall from the outside.

5. The cartridge system according to claim 1, wherein a circumferential shoulder edge is formed on the shoulder element and rests on the end-face edge of the sleeve wall at the delivery-side end of the sleeve.

6. The cartridge system according to claim 5, wherein an undercut is formed on the shoulder element on the inside adjacent to the circumferential shoulder edge.

7. The cartridge system according to claim 1, wherein the shoulder element has an external thread adjacent to the outlet opening, via which thread the shoulder element can be connected to a dispensing nozzle.

8. The cartridge system according to claim 1, wherein the outlet opening is closed off by a breakaway reclosure part.

9. The cartridge system according to claim 1, wherein the closure element comprises a plunger that is displaceable within the sleeve and a closure ring pressed into the sleeve, the plunger and the closure ring being connected to one another via at least one connecting web designed as a predetermined breaking point.

10. The cartridge system according to claim 9, wherein at least one sealing lip is formed on the circumference of the plunger.

11. The cartridge system according to claim 9, wherein a circumferential shoulder edge is formed on the closure ring and rests on the end-face edge of the sleeve wall at the distal end of the sleeve.

12. The cartridge system according to claim 1, wherein its dimensions are chosen so that it can be used together with a standard caulking gun.

* * * * *